United States Patent [19]

Sugimori

[11] 4,386,265

[45] May 31, 1983

[54] ELECTRONIC CASH REGISTER

[76] Inventor: Hideo Sugimori, 12-2, Koaza Shimokubota, Ohaza Hohsono, Seikacho, Sohrakugun, Kyotofu, Japan

[21] Appl. No.: 130,464

[22] Filed: Mar. 14, 1980

[30] Foreign Application Priority Data

Apr. 4, 1979 [JP] Japan ..... 54-45195[U]

[51] Int. Cl.[3] ..... G07G 5/00; B41J 13/03

[52] U.S. Cl. ..... 235/3; 400/636

[58] Field of Search ..... 235/2, 3, 4, 5, 31 T, 235/46, 58 P, 101; 364/405; 400/636

[56] References Cited

FOREIGN PATENT DOCUMENTS 579136 7/1959 Canada ..... 235/3

OTHER PUBLICATIONS

Data Terminal Systems Model 327 Brochure.

*Primary Examiner*—L. T. Hix
*Assistant Examiner*—Thomas H. Tarcza
*Attorney, Agent, or Firm*—Koda and Androlia

[57] ABSTRACT

The electronic cash register includes a slip printer unit in addition to a two-station printer housed in a main cabinet, wherein the slip printer unit includes a slip printer and a slip feeder both housed in a casing mounted on the long, narrow top surface of the main cabinet, and wherein the slip printer conducts line-by-line printing on the slip paper which is longitudinally fed on the top surface of the main cabinet, thereby enabling the operator to handle the cash register in his easy, natural posture, and additionally admitting of the effective use of the long, narrow top surface of the main cabinet.

8 Claims, 9 Drawing Figures

ELECTRONIC CASH REGISTER

BACKGROUND OF THE INVENTION

1. Field of the Invention

This invention relates to an electronic cash register, and more particularly, to an electronic cash register including three printing stations (hereinafter referred to as a three-station printer), whereby different papers are separately printed for their own purpose; one is as a receipt for customers, a second is as a journal for the seller, and a third is as a guest check (hereinafter referred to as a slip). More specifically, the present invention is concerned with the slip printing station adapted for use in an electronic cash register, wherein the slip printer station is located separately from the other two printing stations to ensure practical and physiological convenience for the operator.

2. Description of the Prior Art

A three-station printer cash register per se is known and in wide use; two examples are shown in FIGS. 1 and 2. The cash register illustrated in FIG. 1 has a three-station printer in the left-hand section of the cabinet 1, wherein the printer is provided with a slit 2 through which a slip paper is inserted. In the slit 2 a slip tray 3 is provided to support the slip, wherein a greater part of the slip tray protrudes beyond the cabinet 1 as shown in FIG. 1. The slip paper is fed from the front of the cash register toward the back thereof, during which it is printed. The cabinet 1 has a mark 4 on its left side to indicate a line at which the printing starts. However, this location is inconvenient for the operator, because he must bend his head leftward to align the mark with the desired starting-line. In addition, the operator must insert the slip paper with his left hand. Such physical posture leans to physiological discomfort for the operator. It is also disadvantageous that the cash register requires an extra space for admitting of the protrusion of the slip tray 3.

Another example is illustrated in FIG. 2, in which a two-station printer 6 is mounted in the left-hand section of the cash register while a slip printer 7 is mounted in the right-hand section on the cabinet 10, thereby constituting a three-station cash register as a whole. In this example the slip paper is likewise fed from the front of the cash register toward the back thereof. This latter type of cash register is known as Model 327 manufactured by Data Terminal System Inc. of Massachusetts, U.S.A. As shown in FIG. 2, the top surface of the cabinet 10 is rectangular with a relatively long width and a relatively short depth. The slip tray 8 must be placed in a limited area on the cabinet, and according its length is necessarily shortened in comparison with the width of the cash register. In addition, its extension frontward is not allowable because of a possible hindrance for the operator, nor is its extension backward allowable unless an additional space is provided in the back of the cash register. The mark 11 is also provided on the left side of the printer 7, thereby causing the same inconvenience for the operator. In addition, owning to the shortened slip tray, the slip paper is likely to droop down as shown in FIG. 2, which requires the operator to support it by hand. Likewise, when the printing is finished, the operator also must hold the slip paper from slipping off the cash register. This is troublesome for the operator.

In general, office machines, such as a typewriter with a reader puncher, have such a construction as to feed a tape or card perpendicularly to the operator, and this is no exception to known conventional cash registers.

The present invention is directed toward solving the inconvenience and disadvantages pointed out above, and has for its object to provide an improved three-station electronic cash register in which the slip paper is fed in parallel with the operator's breast who stands in front of the cash register.

Another object of the present invention is to provide an improved three-station electronic cash register in which a slip paper can be inserted and taken out by a normal, easy action of arms, that is, in the operator's natural posture.

A further object of the present invention is to provide an improved three-station electronic cash register occupying as small an installation space as the conventional two-station cash register.

A still further object of the present invention is to provide an improved three-station electronic cash register which can be used in a poor lit room without the use of a special light.

Other objects and advantages of the present invention will be readily understood from the following description and the accompanying drawings.

SUMMARY OF THE INVENTION

The electronic cash register includes a slip printer unit in addition to a two-station printer housed in a main cabinet, wherein the slip printer unit includes a slip printer and a slip feeder both housed in a casing mounted on the long, narrow top surface of the main cabinet, and wherein the slip printer conducts line-by-line printing on the slip paper which is longitudinally fed on the top surface of the main cabinet, thereby enabling the operator to handle the cash register in his easy, natural posture, and additionally admitting of the effective use of the long, narrow top surface of the main cabinet.

DETAILED DESCRIPTION OF THE INVENTION

Figure 1:
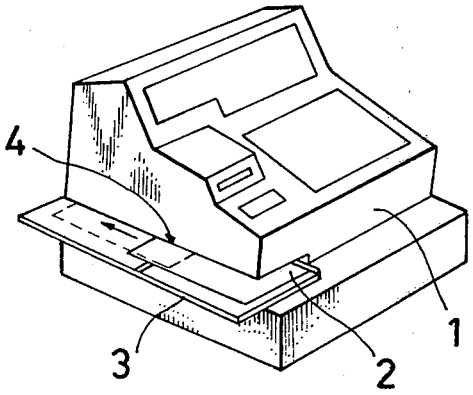
FIG. 1 PRIOR ART
FIGS. 1 and 2 are perspective views showing examples of prior art cash registers.
Figure 2:
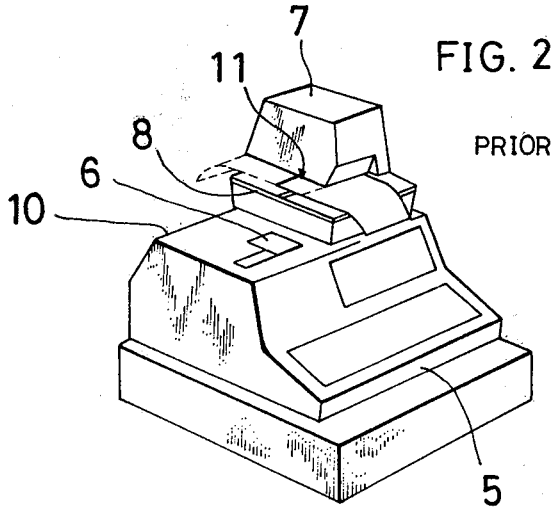
FIG. 2 PRIOR ART
Figure 3:
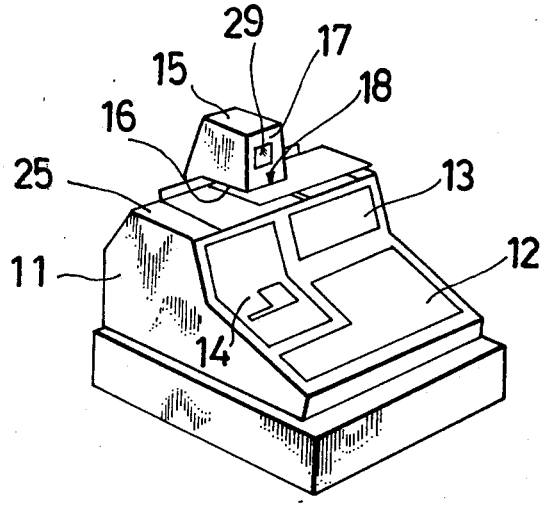
FIG. 3 is a perspective view showing a cash register embodying the present invention.
Figure 4:
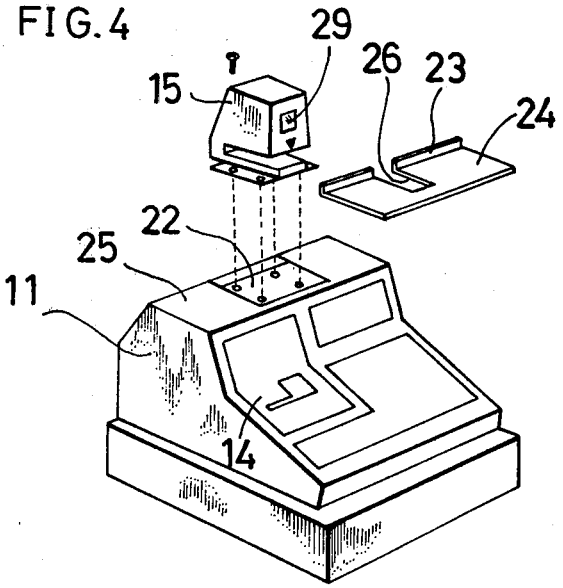
FIG. 4 is an analytical perspective view of the cash register in FIG. 3.
Figure 5:
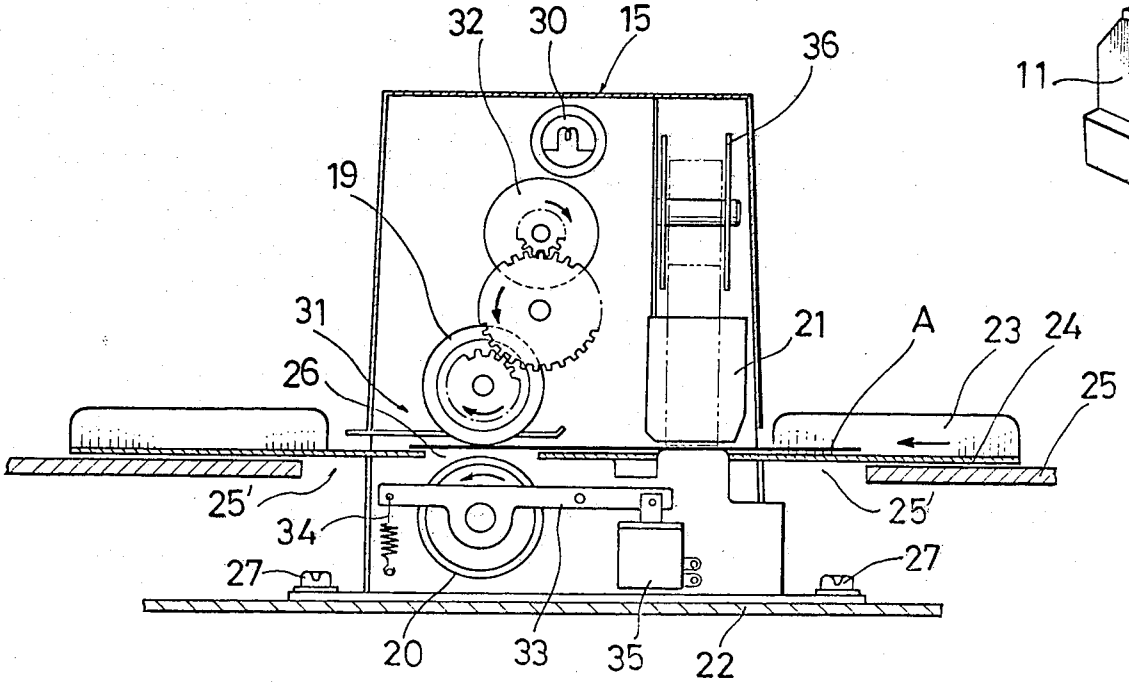
FIG. 5 is a vertical cross-sectional particularly showing the slip printer unit in FIG. 3.

As shown in FIG. 3, the main body of the cash register is covered by a cabinet 11 in which a two-station printer 14 is housed. The cabinet 11 also has a keyboard 12 and a display window 13. A slip printer unit is housed in a casing 15 which is fastened to the frame 22 of the main body by means of fasteners 27. The casing 15 is provided with a slit 16, and the portion of the top surface 25 of the cabinet which corresponds to the slit 16 is cut away at 25' so as to accept the casing 15 as shown in FIG. 5. The cut-away portion 25' of the top surface 25 is covered by a slip tray 24. The slip tray 24 is also provided with its cut-away portion 26, and with a guide 23 at its backward edge. The slit 16 of the casing is engaged with the cut-away portion 26 of the slip tray to allow a feed roller 19 and a pinch roller 20 of a slip feeder 31 to be engageable with each other therein. This will be more particularly described below. The slip printer unit is composed of a slip printer 21 and a slip feeder 31. Reference numeral 18 denotes a mark to indicate a place at which the printing starts. The casing 15 is provided with a window 29 through which an inside lamp 30 throws its light.

Referring to FIG. 5, the slip printer unit will be explained in greater detail:

The slip feeder 31 includes the feed roller 19 and the pinch roller 20, wherein the feed roller is driven by an electric motor 32 through a suitable gear train. The feed roller 19 and pinch roller 20 rotate in the direction indicated by the respective arrows in FIG. 5 to feed the slip paper (A) to the left in the drawing. The pinch roller 20 is carried on a lever 33 whose top end is connected to the casing 15 by means of a coil spring 34. The lever 33 is connected to an electromagnet 35 at the other end. When the electromagnet 35 is energized, the pinch roller 20 is placed into contact with the feed roller 19 against the coil spring 34, and when it is deenergized, the pinch roller 20 comes out of contact with the feed roller 19, and returns to its original position under the urge of the coil spring 34. In order to increase the friction between the feed roller and pinch roller, each roller can be made of rubber, or can be provided with a rubber surfacing on each periphery.

Figure 8:
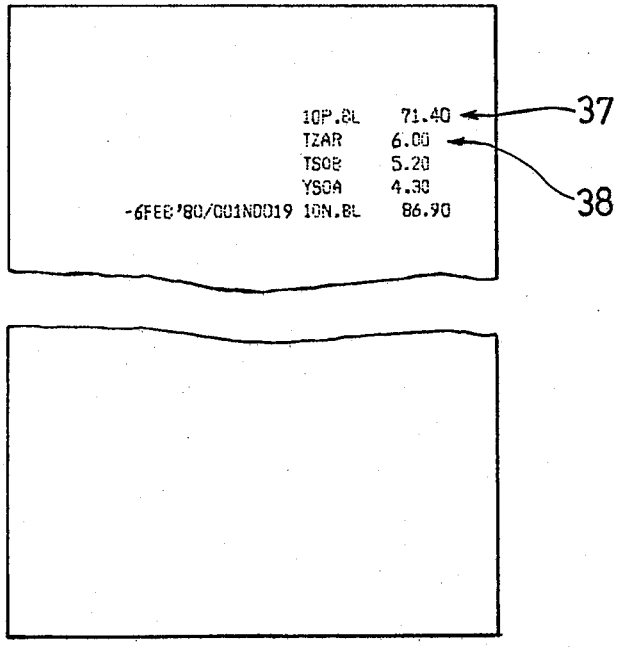
FIG. 8 is a plan view of a slip on which line-by-line printings are made.

The slip printer 21 is a known stylus printer, consisting of a dot matrix printer head (hereinafter referred to as the head) and a scanner causing the head to scan over the surface of the slip paper to effect line patterns of printing. In FIG. 5 the head travels perpendicular of the plane of the drawing paper, that is, toward and from the operator who stands in front of the cash register. FIG. 8 shows a sample of a printed slip, wherein individual characters are formed by 5×7 dot matrix. The given data is printed in a single line with these characters. The head includes seven needle elements which are selectively driven under the control of a central processing unit 42 (hereinafter referred to as the CPU). The scanner also causes the head to scan over the surface of the slip paper under the control of the CPU. The slip printer 21 is supplied with an ink ribbon from a reel 36. During a single scanning of the head the needle elements are selectively driven to print a line 37. At this stage the pinch roller 20 is kept out of contact with the feed roller 19 under the deenergization of the electromagnet 35. When the line 37 is completely printed, the electromagnet 35 is energized under the control of the CPU, thereby causing the pinch roller 20 to come into contact with the feed roller 19. As a result the slip paper (A) is longitudinally fed merely by the distance of a line, and the next line 38 is printed. In this way the whole desired printing is conducted line by line during the intermittent longitudinal feeding of the slip paper.

Figure 9:
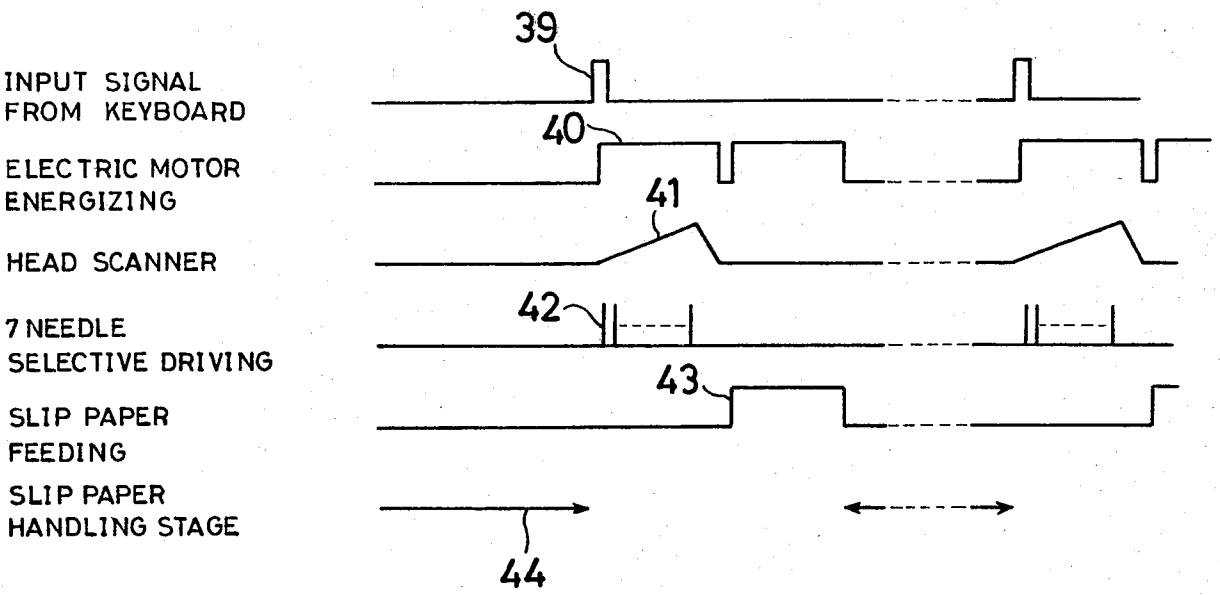
FIG. 9 is a timing diagram illustrating the sequence of the slip printing operation.

Referring to FIG. 9, a typical example of operation will be explained:

The slip paper (A) is inserted by the operator into the slit 16 by setting the desired starting line to the mark 18. This term corresponds to the Slip Paper Handling Stage 44 in FIG. 9. The input signal is transmitted from the keyboard 12 to the CPU 42 (Stage 39), thus initiating the operation of the slip printer unit. The electric motor 32 is energized (Stage 40), and at the same time the head is initiated to scan (Stage 41), while the needle elements are selectively driven under the control of the CPU (Stage 42). In this way the first line 37 (FIG. 8) is printed. Then the head is caused to return to its starting position. The electric motor 32 and the electromagnet 35 are respectively energized, whereby the slip paper (A) is longitudinally fed merely by the distance of a line due to compression between the feed roller 19 and the pinch roller 20 (Stage 43). When the next printing line 38 comes under the mark 18, the feeding of the slip paper stops as a result of the release of pinch roller 20 from the slip paper (A) due to the deenergization of the electromagnet 35. A further input signal is transmitted from the keyboard 12 for printing the second line 38.

In this way the printing is conducted line by line on the slip paper under the control of the CPU 42. When the whole desired printing is finished, the slip paper (A) comes out of contact with the feed roller and the pinch roller.

Figure 6:
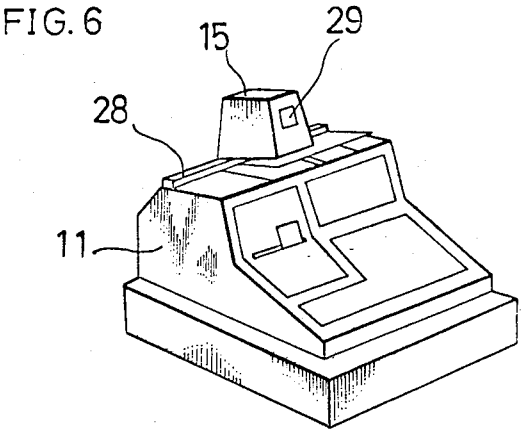
FIG. 6 is a perspective view showing a modified embodiment.

The embodiment illustrated in FIG. 6 has a cabinet 11 whose top surfaces 25 is slanted rearward. In addition, the top surface 25 is provided with a guide 28 in alignment with the guide 23 of the slip tray 24. Thus, the slip paper (A) can safely rest on the top surface of the cash register after it has been released from the rollers 19 and 20.

Figure 7:
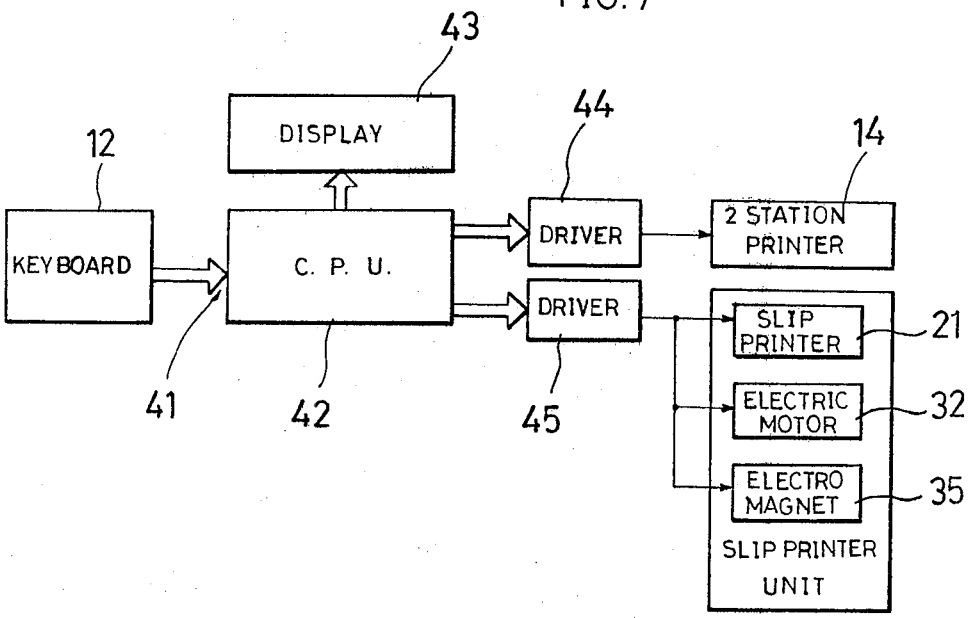
FIG. 7 is an electric block diagram.

Referring to FIG. 7, an input terminal 41 is electrically connected to the keyboard 12 to generate signals. The keyboard includes many keys, that is 0 to 9 numbered keys, a point key, and functional keys, such as an itemizing key and a transaction key.

The CPU 42 includes a read-only memory for storing programs; a random access memory for storing input and output signals and figures under arithmetical operation; an arithmetical circuit, and a timing-signal generator circuit. A display circuit 43 is to indicate the signals of the CPU 42. A two-station printer drive circuit 44 is to impress the output signals provided by the CPU 42 on the two-station printer 14. A slip printer drive circuit 45 is to impress the output signals provided by the CPU 42 on the slip printer 21, in association with which the electric motor 32 and the electromagnet 35 are controlled.

What is claimed is:

1. A three station printer electronic cash register comprising:

a central processing unit;

a two station printer for separately printing individual customer receipts and a transaction journal under the control of said central processing unit;

a keyboard for permitting an operator to enter input data for processing by said central processing unit;

a display for displaying output data processed by said central processing unit;

a frame for supporting said central processing unit, said two station printer, said keyboard and said display;

a main cabinet for housing said frame and said central processing unit, said two station printer, said keyboard and said display supported thereby, said cabinet having a top surface provided with a cut-away portion spaced above a corresponding surface of said frame, said top surface extending longitudinally across substantially the entire width of said cash register, said cabinet being further provided with a second surface provided with a display window area through which the data displayed by said display may be viewed by said operator, said second surface being disposed at a level lower than that of said top surface;

a slip tray for supporting a guest check slip paper;

slip feeding means for longitudinally feeding said guest check slip paper supported by said slip tray the distance of one line, said slip feeding means comprising a feed roller and a pinch roller selectively engageable therewith, said pinch roller and said feed roller being rotatable about respective axes oriented perpendicular to the direction of feeding;

slip printing means for printing a line of printed data on said guest check slip paper supported by said slip tray;

a slip feeder casing for housing said slip feeding means and said slip printing means, said slip feeder casing being provided with a forwardly facing slit to accept said slip tray, said slip feeder casing being thereby divided into two vertically opposed portions, one of which houses said feed roller and the other of which houses said pinch roller, said slip tray being provided with a cut-away portion contained within said slip feeder casing slit to permit the lower one of said feed roller and said pinch roller to make direct contact with a bottom surface of said guest check slip paper whereby when said pinch roller engages said drive roller, a rotating motion of said feed roller will result in a longitudinal motion of said guest check slip paper;

means for rigidly mounting said slip feeder casing to said frame with the lower one of said vertically opposed portions recessed into said main cabinet top surface cut-away portion such that said slip tray is disposed immediately above said main cabinet top surface, whereby said top surface will function to prevent the drooping of said guest check slip paper as it extends longitudinally beyond said slip tray;

guide means located at the rear of said top surface for facilitating the lateral positioning of said guest slip paper with respect to said feeding means such that the longitudinal axis of said guest check slip paper is oriented parallel to the longitudinal axis of said top surface and perpendicular to said pinch roller and feed roller rotational axes; and index means for facilitating the longitudinal positioning of said guest check slip paper with respect to said printing means such that said line of printed data is printed at the desired starting line location on said guest check slip paper.

2. The cash register of claim 1, wherein said slip feeding means further comprises an electromagnet located in said slip feeder casing for selectively engaging said pinch roller with said feed roller in response to control signals from said central processing unit.

3. The cash register of claim 1, wherein said slip printing means comprises a slip printing head moving in a lateral direction perpendicular to said longitudinal axis of said guest check slip paper and said longitudinal axis of said top surface.

4. The cash register of claim 1, wherein said guide means comprises an upwardly facing surface provided at the backward edge of said slip tray.

5. The cash register of claim 4, wherein said guide means further comprises a second upwardly facing surface provided on said main cabinet top surface, said second upwardly facing surface being in alignment with said slip tray upwardly facing surface.

6. The cash register of claim 5, wherein said main cabinet top surface is slanted rearward and said guide means further functions to prevent said guest check slip paper from falling off the rear edge of said main cabinet top surface once it has been released by said feed roller and said pinch roller.

7. The cash register of claim 1, wherein said index means comprises a mark on said slip feeder casing to indicate the location at which the printing of information will start.

8. The cash register of claim 7, wherein said index means further comprises a lamp inside said slip feeder casing and a window through which light from said lamp may be cast on said mark and on the portion of said guest check slip paper in the vicinity of said mark.

* * * * *